United States Patent [19]

Ormiston

[11] 4,325,304

[45] Apr. 20, 1982

[54] PYROTECHNIC DEVICES AND SYSTEMS AND FIRING CIRCUITS THEREFOR

[75] Inventor: Peter T. Ormiston, Farnham, England

[73] Assignee: The Solartron Electronic Group Limited, Farnborough, England

[21] Appl. No.: 116,436

[22] Filed: Jan. 29, 1980

[30] Foreign Application Priority Data

Feb. 3, 1979 [GB] United Kingdom ..... 03866/79

[51] Int. Cl.[3] ..... F42C 15/40; F42B 4/24

[52] U.S. Cl. ..... 102/200; 102/217; 102/360

[58] Field of Search ..... 102/217, 206, 200, 37.7, 102/37.2, 37.4, 21.6; 42/76 A

[56] References Cited

U.S. PATENT DOCUMENTS

| | | | |
|---|---|---|---|
| 2,710,478 | 6/1955 | Petersen | 42/76 A |
| 3,228,298 | 1/1966 | Grandy et al. | 42/76 A |
| 3,262,388 | 7/1966 | McCarty | 102/217 |
| 3,712,230 | 1/1973 | Hoffmann | 102/217 |
| 3,722,418° | 3/1973 | Hoffmann | 102/217 |
| 4,099,467 | 7/1978 | MacKellar et al. | 102/217 |
| 4,217,717 | 8/1980 | Canty et al. | 102/200 |

FOREIGN PATENT DOCUMENTS

| | | |
|---|---|---|
| 758115 | 9/1956 | United Kingdom . |
| 781260 | 8/1957 | United Kingdom . |
| 1159902 | 7/1969 | United Kingdom . |
| 1170177 | 11/1969 | United Kingdom . |
| 1262623 | 2/1972 | United Kingdom . |
| 1291778 | 10/1972 | United Kingdom . |
| 1327266 | 8/1973 | United Kingdom . |
| 1356526 | 6/1974 | United Kingdom . |
| 1422557 | 1/1976 | United Kingdom . |
| 1535878 | 12/1978 | United Kingdom . |

*Primary Examiner*—Charles T. Jordan

*Attorney, Agent, or Firm*—Dale V. Gaudier; Mikio Ishimaru

[57] ABSTRACT

A pyrotechnic system comprises a plurality of pyrotechnic charges or devices 20 arranged in a matrix of recesses 14 formed in a block 12 of a synthetic resin material.

In one embodiment, each device 20 contains a fast-burning pyrotechnic composition 42 arranged to be fired by an electrical primer 50, for producing a flash and/or a bang, and a slow-burning pyrotechnic composition 40 separated from the composition 42 and arranged to be ignited by the firing of the composition 42. Embedded in the composition 40 is a fine wire loop 48 which is ruptured by the burning of the composition 40. The primers 50 of the devices 20 are connected in parallel between two input terminals 52, 54, and each loop 48 is connected to short-circuit the primer 50 of the next device 20 in the firing sequence. The pyrotechnic system is thus self-sequencing.

In another embodiment, respective rupturable conductors 98 are formed on blast-removable portions 96 of a printed circuit which is secured to the top of the block 12 with the blast-removable portions disposed over the mouths of the recesses 14.

14 Claims, 8 Drawing Figures

PYROTECHNIC DEVICES AND SYSTEMS AND FIRING CIRCUITS THEREFOR

This invention relates to pyrotechnic devices and systems, and to firing circuits therefor. The invention is more particularly, but not exclusively, concerned with such devices, systems and circuits for use in weapon simulation systems, eg of the type described and claimed in our U.K. Pat. Nos. 1,228,143 and 1,451,192, to simulate the flash and/or the report produced by the firing of a gun.

A known pyrotechnic system for simulating gunfire comprises a plurality of electrically-firable pyrotechnic charges arranged in a matrix, and and electrical firing circuit for firing the charges in a predetermined sequence. The firing circuit includes a sequencer for controlling the predetermined sequence in which the charges are fired, this sequencer typically comprising either a uniselector electromechanical switch or its electronic equivalent. The former has the advantage of simplicity and inherent safety, and provides a non-volatile memory of which charges have been fired; however, it has the disadvantage of being relatively expansive. The latter can be relatively inexpensive, but has the disadvantage that it cannot easily be arranged to provide a non-volatile memory of which charges have been fired.

It is an object of the present invention to provide pyrotechnic devices and systems, and firing circuits therefor, in which the disadvantages due to the use of the known forms of sequencer are substantially alleviated.

According to one aspect of the present invention, there is provided a pyrotechnic system comprising:

a plurality of pyrotechnic charges each having a respective electrically-operable primer for firing it; and electric circuit means for applying electric firing signals to the primers;

wherein said electric circuit means comprises at least two input terminals for receiving said firing signals; the primers are connected in parallel circuit paths between said input terminals; the charges are arranged in a predetermined firing sequence in respective chambers in a common housing member; and each charge is associated with a respective rupturable conductor which is connected effectively to substantially short-circuit the primer of the next charge in the firing sequence and which is arranged to rupture in response to firing of its associated charge; whereby the firing of each of the second and subsequent charges in the firing sequence is enabled only after the preceding charge has been fired.

Preferably, each pyrotechnic charge comprises a principal, relatively fast-burning, pyrotechnic material with the electrically operable primer embedded therein, and an auxiliary, relatively slow-burning, pyrotechnic material arranged to be ignited by the firing of the principal material. The rupturable electrical conductor is arranged to be ruptured by the burning of the auxiliary pyrotechnic material only after the principal pyrotechnic material has been fired. Alternatively, each rupturable conductor is disposed adjacent the mouth of the chamber of the charge associated with the conductor, so as to be ruptured by the blast produced by firing the charge.

The invention will now be described, by way of non-limitative example only, with reference to the accompanying drawings, of which:

Figure 1:
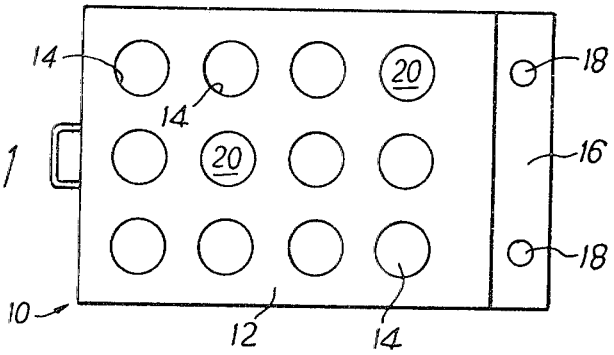
FIG. 1 is a schematic plan view of a pyrotechnic system in accordance with the present invention.
Figure 2:
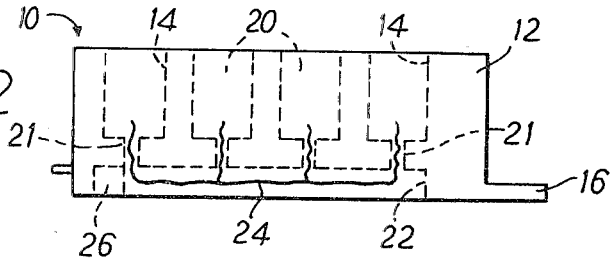
FIG. 2 is a side view of the pyrotechnic system of FIG. 1.
Figure 3A:
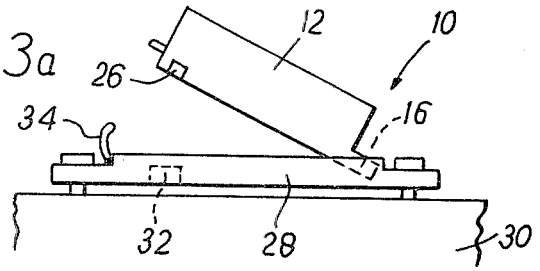
Figure 3B:
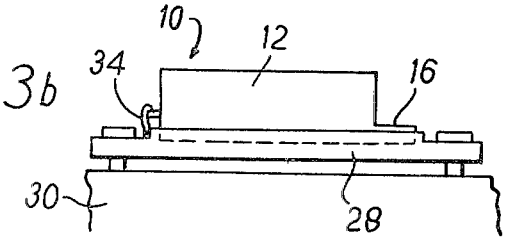
Figure 4:
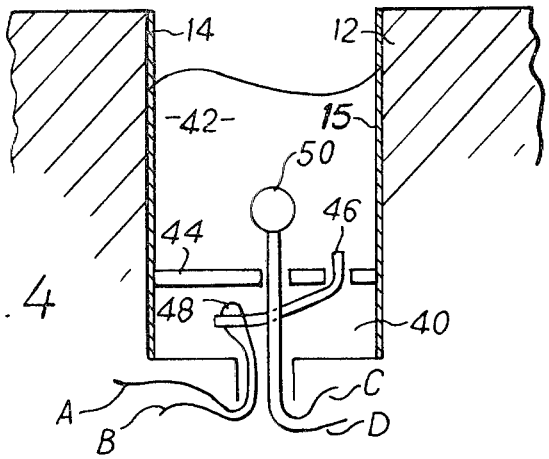
Figure 6:
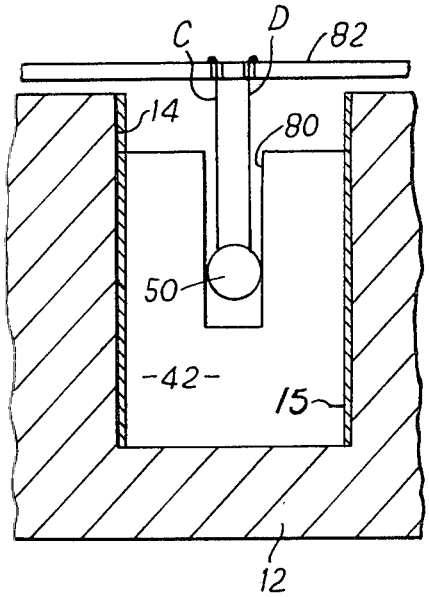
Figure 7:
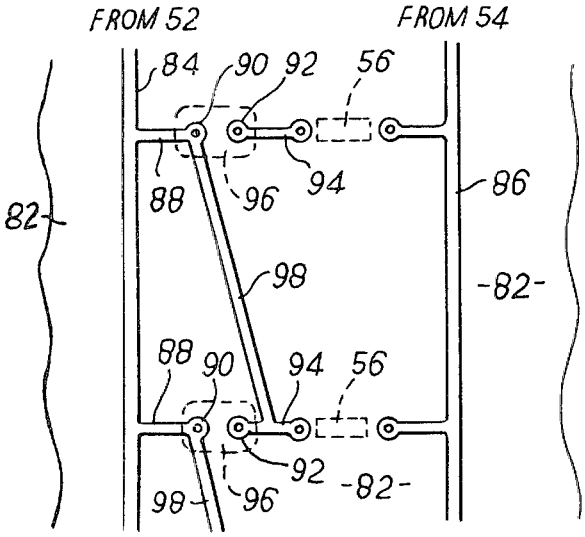
Figure 5:
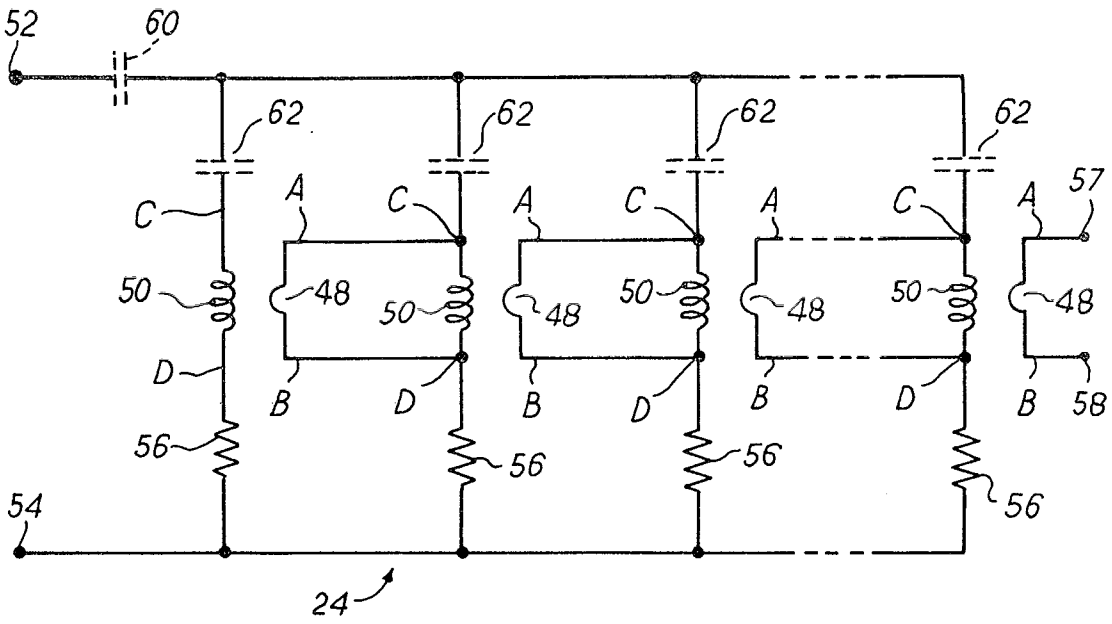

FIGS. 3*a* and 3*b* show schematically how the pyrotechnic system of FIGS. 1 and 2 is mounted on a vehicle such as a tank;

FIG. 4 is a more detailed sectional view of a single pyrotechnic device which forms part of the system of FIGS. 1 and 2;

FIG. 5 shows a firing circuit for use in the pyrotechnic system of FIGS. 1 and 2;

FIG. 6 is a sectional view of part of an alternative embodiment of the system of FIG. 1, also in accordance with the present invention; and FIG. 7 is a plan view of part of a printed circuit implementation of the firing circuit of FIG. 5, as used in the system of FIG. 6.

The pyrotechnic system shown in FIGS. 1 and 2 is indicated generally at 10, and is intended for use in a weapon simulation system of the type described and claimed in the aforementioned U.K. patent specifications. The system 10 comprises a disposable rectangular block 12 having a matrix of substantially cylindrical recesses or chambers 14 formed in its upper surface. The block 12 is cast in a suitable low cost synthetic resin material, eg of the araldite type, and has an integrally form locating flange 16, containing locating holes 18, projecting from one end.

Each of the chambers 14 contains a pyrotechnic device 20 which will be described in more detail hereinafter, and communicates via a respective hole 21 with a common wiring chamber 22 constituted by a recess formed in the underside of the block 12. A firing circuit 24, which will also be described in more detail hereinafter, is disposed in the wiring chamber 22, and is sealed therein by filling the chamber 22 with a casting compound after all the connections between the firing circuit 24 and the pyrotechnic devices 20 have been completed. A recessed male electrical connector 26, forming the input to the firing circuit 24 and typically comprising a two-pin connector, is also cast into the chamber 22.

As shown in FIGS. 3*a* and 3*b*, the pyrotechnic system 10 also includes a robust rectangular mounting frame 28 shaped to receive the block 12, whereby the system 10 may be clamped or otherwise firmly secured to a suitable part 30 of a vehicle, such as a tank, with which the aforementioned weapon simulation system is being used. The locating flange 16 of the block 12 is first inserted into one end of the frame 28, as shown in FIG. 3*a*, so that the locating holes 18 engage correspondingly positioned locating pins (not shown) provided in the frame, and the block 12 is then pivotted into a closed position in the frame, as shown in FIG. 3*b*.

The frame 28 contains a female electrical connector 32, which is engaged by the male connector 26 in response to the act of pivoting the block 12 into the frame. The female connector 32 is connected to receive electrical firing signals generated in known manner in the weapon simulation system in the vehicle.

The frame 28 has a two-position catch 34, having a principal, fully closed position in which it locks the block 12 fully into the frame 28 with the connectors 26 and 32 engaged, so that the system 10 is armed, and an auxiliary, partially-open, position in which the block 12 is still locked to the frame 28 but with the connectors 26, 32 held disengaged, so that the system 10 is disarmed. The difference between the two positions is clearly visually apparent, so that it can be perceived at a glance whether the system 10 is armed or disarmed.

One of the pyrotechnic devices 20 is shown in more detail in FIG. 4, and comprises a relatively slow-burning pyrotechnic material or composition 40 disposed in the base of its chamber 14 in the block 12, and a relatively fast-burning (ie flash-producing) pyrotechnic material or composition 42 filling the remainder of the chamber 14. A cardboard disc 44 separates the two compositions, and a fuse 46 extends from the fast-burning composition 42 to the slow-burning composition 40 through a hole in the disc.

A loop of fine wire 48, eg of copper, is embedded in the slow-burning composition 40, the opposite ends A and B of this loop being insulated from each other and passing through the hole 21 (and thence into the wiring chamber 22 of FIG. 2). Additionally an electrically-detonatable "match head" primer 50 of known type is embedded in the fast-burning composition 42, and has electrical leads C and D which pass through the same or another hole in the disc 44, and through the slow-burning composition 40 and the hole 21, into the wiring chamber 22.

FIG. 5 shows one embodiment of the firing circuit 24, comprising a pair of input terminals 52, 54 constituted by the pins of the two-pin connector 26 of FIG. 2. Each of the primers 50 is connected in series with a respective current-limiting resistor 56 between the terminals 52, 54. Additionally, the wire loop 48 of each pyrotechnic device 20 in the firing sequence is connected in parallel with, and thus short-circuits, the primer of the following device in the sequence (with the exception that the wire loop 48 of the last device 20 in the sequence is not used, or alternatively, is connected to two output terminals 57, 58 whose purpose will be explained later).

In operation, firing pulses of typically 28 volts amplitude and 10 milliseconds duration are applied between the input terminals 52, 54, each such pulse being produced, for example, by the aforementioned weapon simulation system in response to the operation of the trigger of a weapon carried by the vehicle. The first such pulse causes a current of typically 100 milliamps to flow through the primer 50 of the first pyrotechnic device 20 in the firing sequence, and only through this particular primer, since the respective primers of all the other pyrotechnic devices 20 are short-circuited by respective ones of the wire loops 48. The primer 50 of the first pyrotechnic device 20 is therefore detonated, thus firing the fast-burning flash-producing pyrotechnic composition 42. The firing of the composition 42 typically occurs in a few milliseconds, and produces a bright flash and a loud report which together simulate the firing of the aforementioned weapon.

The firing of the composition 42 also ignites the fuse 46, which in turn ignites the slow-burning composition 40. The slow-burning composition 40 is arranged to have a typical burn time of about ½ second to 1 second, during which time it burns through, or ruptures, the wire loop 48 embedded therein. The rupturing of the wire loop 48 thus enables the next pyrotechnic device 20 in the firing sequence, and only this next device, to be fired by the next firing pulse applied to the terminals 52,54.

The duration of each firing pulse applied to the terminals 52, 54 is normally arranged to be considerably less than the time taken by the slow-burning pyrotechnic composition 40 to rupture the wire loop 48. However, if desired, a continuous firing current may be applied to the terminals 52,54, to produce ripple firing of the pyrotechnic devices 20, the time intervals between successive firings being largely determined by the burning rate of the slow-burning pyrotechnic composition 40.

It will be appreciated that the pyrotechnic system 10 is effectively selfsequencing, in that the firing sequence of the individual pyrotechnic devices 20 is determined by the devices themselves and the order in which they are electrically connected together by the firing circuit 24. In particular, no uniselector electromechanical switch or its electronic equivalent is necessary, and the wiring of the firing circuit 24 is dramatically simplified, both of which features lead to significant cost reductions in comparison with prior art pyrotechnic systems.

In order to reduce the possibility of inadvertent ripple firing of the pyrotechnic devices, the firing circuit 24 can be modified by connecting a capacitor, shown dotted at 60 in FIG. 5, in series between the terminal 52 and the primers 50, forming with the primers and their current-limiting resistors 56 a differentiating circuit. Alternatively, to avoid the problem of a changing resistance value associated with the capacitor 60, respective capacitors can be connected in series with each primer 50, as shown dotted at 62, or in series with groups of, say, three primers. Where the only DC voltage readily available is particularly noisy, a pulse-forming circuit based on an integrated circuit voltage regulator can be used in place of the capacitor(s): advantageously this regulator is connected in series with the female electrical connector 32 in the frame 28.

Many modifications can be made to the described embodiment of the invention. For example, the block 12 can be moulded from a suitable plastics material, and/or instead of being planar as described, can be shaped to at least partly conform to part of the vehicle or weapon with which it is to be used. Also, the chambers 14 need not be cylindrical, and can if necessary be provided with a reinforcing lining, for example by inserting a metal tube 15 (FIGS. 4 and 6), eg of steel, in each of them. Additionally, metallic screening layers, electrically connected to the metal tubes if these latter are present, can be incorporated in the block 12, eg during the casting thereof, to protect the firing circuit 24 from radio frequency or other electrical interference. In applications where a relatively small flash and report is sufficient, the block 12 can be constituted by a matrix of individual pyrotechnic devices in cardboard tubes which are suitably bonded together.

Further, the frame 28 can be adapted to accommodate two blocks 12. In this case, the male connector of the second block engages a female connector mounted in the frame and connected in parallel with the female connector engaged by the first block, and a connection is provided between the aforementioned output terminals 57, 58 (FIG. 5) of the first block and auxiliary input terminals of the second block, which auxiliary input terminals are coupled to the leads C and D of the primer of the first charge in the firing sequence of the second block. With this arrangement, it should be ensured that a partially-used block always occupies the position of the block referred to as the first block. Obviously, more than two blocks can be accommodated if desired.

The embodiment of the invention shown in FIGS. 6 and 7 is similar in many respects to the embodiment of FIGS. 1 and 2, so corresponding parts have been given the same reference numbers and only the points of difference will be described.

Thus in the pyrotechnic system of FIGS. 6 and 7, the recesses 14 in the block 12 are blind recesses, ie the holes 21 of FIGS. 1 and 2 are omitted. These blind recesses 14 each contain a charge 20 comprising only a single pyrotechnic material or composition, which consists of the relatively fast-burning (ie flash-producing) pyrotechnic composition 42. The composition 42 itself contains a blind recess 80, approximately coaxial with the blind recess 14, for receiving its respective primer 50, which projects into the recess 80 from a printed circuit formed on a common insulating support 82 covering the mouths of all the recesses 14.

This printed circuit forms most of the interconnections of the firing circuit of FIG. 5, and thus replaces the wiring and other circuitry which was disposed in the chamber or recess 22 in the underside of the block 12 in the embodiment of FIGS. 1 and 2. Part of the printed circuit is shown in FIG. 7, and comprises first and second principal conductive tracks 84, 86 deposited on the support 82. The principal tracks 84, 86 are ultimately connected to the terminals 52, 54 respectively of the connector 26 in the recess 22 in the underside of the block 12 (eg by wires which extend through or around one end of the block 12). The track 84 has a plurality of spur tracks 88 projecting therefrom to respective connecting pads 90, in each of which is soldered the leg or lead C of a respective primer 50. The other leg or lead D of the primer is soldered in a connecting pad 92 adjacent the pad 90, the pad 92 being connected via another spur track 94, having a respective one of the resistors 56 series connected therein, to the principal track 86.

The support 82 has a plurality of weakened portions 96, each formed by perforating the support all around the portion. Each portion 96 is aligned with the mouth of a respective one of the recesses 14 in the block 12, and may therefore typically include the pads 90, 92 of the primer 50 in that recess, as shown in FIG. 7. Each portion 96 also has part of a further conductive track 98 thereon, each track 98 extending from a spur track 88 connected to one primer 50 to the portion of spur track 94 connected to the leg or lead D of the primer 50 of the next charge 20 in the firing sequence. Thus each track 98 crossing a portion 96 associated with one charge 20 in the firing sequence short-circuits the primer 50 of the next charge 20 in the firing sequence. The tracks 98 thus effectively perform the same function as the wire loops 48 of the embodiment of FIGS. 1, 2 and 4.

Thus when a suitable firing pulse is applied to the input terminals 52,54, it detonates the only primer 50 of the first charge 20 in the firing sequence, since all the other primers 50 are short-circuited by respective ones of the tracks 98. Detonation of this first primer fires the composition 42 of the first charge 20 in the firing sequence, and the blast produced by this firing blows out the weakened portion 92 disposed over the mouth of the recess 14 containing the first charge. This in turn breaks or ruptures the track 98 crossing the blown-out portion 92, thereby enabling the firing of the next charge 20 in the firing sequence by the next firing pulse applied to the terminals 52, 54. It will be appreciated that the duration and energy content of each firing pulse should be selected to be sufficient for firing only one primer 50.

The support 82 can be secured to the block 12 in any convenient manner, with the printed circuit tracks disposed on the side thereof facing away from the block and with the primers 50 and the resistors 56 disposed on the side facing towards the block. The block 12 can also be provided with small recesses to accommodate the resistors 56, to enable the support 82 to fit flush with the block.

In addition to most of the modifications described in relation to the embodiments of FIGS. 1 and 2, several other modifications can be made to the embodiment of FIGS. 6 and 7.

In particular, the portions 96 of the support 82 can be further weakened, by additional perforations, so that in operation they are effectively completely disintegrated by the blast produced by their respective charge. Also, the rupturable conductors constituted by the tracks 98 on the portions 96 need not be implemented in printed circuit form: they can instead be fine wires arranged in the path of the blast produced by their associated charge.

The pyrotechnic systems described herein are particularly economical in terms of cost per charge fired. Additionally, because of the particularly simple form of the firing circuit included in the block 12, this block can be treated as a disposable component.

I claim:

1. A pyrotechnic system comprising:

a plurality of pyrotechnic charges each including a principal, relatively fast-burning, pyrotechnic material, an electrically-operable primer for firing said principal pyrotechnic material and an auxiliary, relatively slow-burning, pyrotechnic material arranged to be ignited by the firing of said principal material; and electric circuit means for applying electric firing signals to the primers;

wherein said electric circuit means comprises at least two input terminals for receiving said firing signals; the primers are connected in parallel circuit paths between said input terminals; the charges are arranged in a predetermined firing sequence in respective chambers in a common housing member; and each charge is associated with a respective rupturable conductor which is connected effectively to substantially short-circuit the primer of the next charge in the firing sequence and which is arranged to be ruptured by the burning of the auxiliary pyrotechnic material only after said principal pyrotechnic material has been fired; whereby the firing of each of the second and subsequent charges in the firing sequence is enabled only after the preceding charge has been fired.

2. A pyrotechnic system as claimed in claim 1, wherein the principal and auxiliary pyrotechnic materials are disposed in a common chamber but separated from each other by a partition, a fuse extending from the principal material to the auxiliary material.

3. A pyrotechnic system comprising:

a plurality of pyrotechnic charges each having a respective electrically-operable primer for firing it; and electric circuit means for applying electric firing signals to the primers;

wherein said electric circuit means comprises at least two input terminals for receiving said firing signals; the primers are connected in parallel circuit paths between said input terminals; the charges are arranged in a predetermined firing sequence in respective chambers in a common housing member; each charge is associated with a respective rupturable conductor which is disposed adjacent the mouth of the chamber of the charge associated with the conductor and arranged so as to be ruptured by the blast produced by firing the charge; and each rupturable conductor is connected effectively to substantially short-circuit the primer of the next charge in the firing sequence; whereby the firing of each of the second and subsequent charges in the firing sequence is enabled only after the preceding charge has been fired.

4. A pyrotechnic system as claimed in claim 3, wherein the rupturable conductors are formed as printed circuit conductors on a common insulating support.

5. A pyrotechnic system as claimed in claim 4, wherein the insulating support covers the mouths of the chambers, and has weakened portions each aligned with the mouth of a respective chamber, each weakened portion having one of said rupturable conductors thereon and being weakened such that, in operation, it is removed by the blast produced by firing its associated charge.

6. A pyrotechnic system as claimed in claim 5, wherein said weakened portions are formed by perforating said insulating support therearound.

7. A pyrotechnic system as claimed in claim 4, wherein at least a part of the electric circuit means is formed as a printed circuit on said insulating support, and wherein the primers are electrically connected to said printed circuit and project into their respective chambers from said support.

8. A pyrotechnic system as claimed in claim 1 or 3, wherein each primer is connected in series with a respective resistance between said first and second terminals.

9. A pyrotechnic system as claimed in claim 8, wherein a common capacitance is connected in series with one of said terminals, up-circuit of the primers.

10. A pyrotechnic system as claimed in claim 8, wherein a respective capacitance is connected in series with each primer.

11. A pyrotechnic system as claimed in claim 1 or 3, wherein the common housing member is moulded in a synthetic resin material.

12. A pyrotechnic system as claimed in claim 1 or 3, wherein the common housing member is moulded in a plastics material.

13. A pyrotechnic system as claimed in claim 1 or 3, wherein each said chamber is cylindrical.

14. A pyrotechnic system as claimed in claim 13, wherein each said chamber has a metal reinforcing lining.

* * * * *